US007397010B2

(12) United States Patent
Wilke

(10) Patent No.: US 7,397,010 B2
(45) Date of Patent: Jul. 8, 2008

(54) SORTING DEVICE FOR FLAT MAIL ITEMS

(75) Inventor: Wolf-Stephan Wilke, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 355 days.

(21) Appl. No.: 10/545,377

(22) PCT Filed: Jan. 30, 2004

(86) PCT No.: PCT/EP2004/000839

§ 371 (c)(1),
(2), (4) Date: Aug. 12, 2005

(87) PCT Pub. No.: WO2004/071680

PCT Pub. Date: Aug. 26, 2004

(65) Prior Publication Data

US 2006/0102529 A1 May 18, 2006

(30) Foreign Application Priority Data

Feb. 12, 2003 (DE) ..... 103 05 847

(51) Int. Cl.
*B07C 5/00* (2006.01)

(52) U.S. Cl. ..... 209/584; 209/900; 209/912

(58) Field of Classification Search ..... 209/583, 209/584, 900, 912
See application file for complete search history.

(56) References Cited

U.S. PATENT DOCUMENTS 5,718,321 A * 2/1998 Brugger et al. ..... 198/359
5,994,657 A * 11/1999 Maier et al. ..... 209/584
7,201,277 B2 * 4/2007 Wilke ..... 209/44.4
7,235,756 B2 * 6/2007 De Leo et al. ..... 209/584

FOREIGN PATENT DOCUMENTS

| | | | |
|---|---|---|---|
| EP | 0 608 161 | A1 | 7/1994 |
| EP | 0 820 818 | A1 | 1/1998 |
| EP | 0 949 015 | A2 | 10/1999 |
| GB | 2 047 189 | A | 11/1980 |
| GB | 2 101 552 | A | 1/1983 |
| WO | WO 97/10 904 | A1 | 3/1997 |

OTHER PUBLICATIONS

Database WPI Section PQ, Week 199305 Derwent Publications Ltd., London, GB; AN 1993-044056 XP002284161 -& SU 1 719 105 A1 (Communications Min Cons Bur) Mar. 15, 1992 Zusammenfassung; Abbildung 1.
Derwent Abstract—EP-0 820 818 A1; Jan. 28, 1998; Grapha-Holding AG, CH-6052 Hergiswil (Switzerland).
Derwent Abstract—EP-0 608 161 A1; Jul. 27, 1994; Bertin & CIE, F-78373 Plaisir (France).

* cited by examiner

*Primary Examiner*—Joseph C Rodriguez

(57) ABSTRACT

The invention relates to a sorting device which includes a mail item buffer storage having storage pouches, circulating in a conveying loop and moving past charge station. Below straight handover sections of the conveying loops, circulating mail from containers, displaced in a conveying path and open to the top, are provided as the sorting terminal points. The mail items are charged into the mail item containers according to their read-out target addresses by controlled opening of the respective storage pouch at that time at which the respective pouch arrives in the respective position above the associated mail item container.

9 Claims, 3 Drawing Sheets

SORTING DEVICE FOR FLAT MAIL ITEMS

BACKGROUND OF THE INVENTION

The present invention relates to a sorting device for flat items of mail, having at least one input station, in each case having a mail separating device and a following transport device for transporting the separated items of mail past process appliances, such as readers, bar code printers, to a loading station of a mail buffer store in each case, the mail buffer store comprising a plurality of storage pockets which circulate in a conveying loop and are moved past the loading stations, and which are loaded with the mail in the loading stations.

In order to sort flat items of mail, such as letters, postcards, small packets and the like in accordance with the, distribution information specified on the surface, it is known to accommodate these items of mail, to transport them and to discharge them in a controlled manner in specific pocket-like containers.

For example, EP 0 608 161 A1 discloses a salting device in which flat objects are transported laterally into storage pockets from outside by means of a channel-like, locally fixed feed device. These storage pockets, circulating in a closed loop, are moved horizontally past the feed device and the items of mail then fall into sorting containers located underneath by means of specific opening of flaps accordance with the sorting stipulation. In order to put the items of mail securely into the moving storage pockets, either the items of mail in the feed device must have a very high transport speed, which can lead to damage when braking the items of mail in the container, or the speed of the storage pockets is very low or the containers are at a standstill during the input, which means a reduction in the throughput of the machine.

For the purpose of ordering in a specific sequence, and solution has been disclosed (EP 820 818 A1) which uses an intermediate store, which comprises storage pockets circulating on a conveyor device in a conveyor loop having at least two semicircular conveyor sections, it being possible for said storage pockets each to pick up an item of mail and to deposit is in the actual tray again when instructed. In this case, initially all the items of mail to be ordered are accommodated in any desired sequence in the storage pockets of the intermediate store. The items of mail are then removed from the storage pockets of the intermediate store and transferred into the trays in such a way that they are located in the latter in the order to be produced. The trays, which are open at the top, are located along the straight sections of the conveyor device, underneath the storage pockets.

In order to improve the input of the items of mail into the storage pockets, according to WO 97/10904 the end section of the transport means of the feed device is designed such that it can be pivoted so that, doing the input of the respective item of mail, this end section is pivoted together with the moved storage pockets in substantially the same direction and at substantially the same speed and, following the input, is pivoted back again.

The throughput of these sorting devices is limited by the throughput of the circulating storage pockets. An increase in the throughput can theoretically be achieved only by increasing the speed and/or reducing the pitch of the transport system of the storage pockets. However, as outlined (input into the storage pockets), this is possible only to a very limited extent.

A sorting device (EP 0 949 015 A2) has also been disclosed which has a plurality of input units, at least one mail buffer store with continuously circulating storage pockets, mail containers as final sorting points, which are filled from the different mail, buffer stores, and with an input and output device for mail containers. In this case, it is possible to manage with fewer final sorting points than there are sorting destinations.

SUMMARY OF THE INVENTION

The invention is placed on the object of providing a sorting device having circulating storage pockets which discharge items of mail in a controlled manner at final sorting points in accordance with the read destination addresses, which has a higher throughput and with which the expenditure for automatically changing the mail containers and for measuring their filling levels can be reduced.

According to the invention, the object is achieved by the features of claim 1.

Here, the sorting device can have a plurality of mail buffer stores with storage pockets in each case circulating continuously in a conveyor loop, arranged one after another and moved past one or two loading stations. Underneath the straight transfer sections of the conveyor loops of the mail buffer store or stores there are mail containers moving on a transport path, circulating continuously and open at the top, as final sorting points assigned to the destination addresses or destination address groups. The items of mail are unloaded into the mail contains in accordance with the read destination addresses by means of controllable opening of the respective storage pocket at the time at which this pocket is located in the appropriate position above the associated mail container. The container transport path has at least one input device for empty mail containers and at least one output device for filled mail containers. The transport speeds of the mail buffer stores and of the mail containers and also the lengths of the transfer sections of the circulation paths of the mail buffer stores which are arranged above the transport path for the mail containers for loading the mail containers are defined in such a way that, during the time interval in which a storage pocket passes through a transfer section of a mail buffer, each mail container has moved through underneath this storage pocket. By means of the new principle— the mail containers are transported to the items of mail— it is possible to increase the throughput without increasing the transport speeds, as a result of parallelization with a flexible arrangement. It is therefore possible to reduce the speed of the storage pockets substantially, which means that the time available for reading the destination addresses as far as reaching the first transfer section is increased.

Advantageous refinements of the invention are presented in the dependent claims.

For example, in order to increase the stacking quality, it is advantageous to incline the storage pockets counter to the transport direction of the mail containers to accommodate the items of mail in an upright position.

Likewise, it is advantageous to incline the circulating mail containers in the same direction, so that an inclined base with one or two preferential stacking edges is produced.

If, in the case of specific items of mail, the destination address cannot be read before the first transfer section is reached, these storage pockets preferably pass through a defined number of transfer sections and if, during this time, the destination addresses could still not yet be read, these items of mail are output to a container for unread items of mail.

It is advantageous if the mail containers transported along directly underneath the transfer sections of the mail buffer stores in each case have the same transport direction as the storage pockets. As a result, the stacking can be carried out cleanly and in a defined manner.

In order to achieve particularly high throughputs, in an advantageous development a plurality of mail buffer stores whose conveyor loops in each case have two straight transverse sections and two semicircular sections with the loading stations are arranged beside each other. The transport path for the circulating mail containers is guided in the shape of a meander underneath the mail buffer stores so that the mail containers transported along directly underneath the transfer sections of the mail buffer stores in each case have the same transport direction as the storage pockets.

In a beneficial embodiment, the storage pockets are open at the side and are led with the open side past the end sections of the transport devices. As a result, the transport direction out of the input station and the orientation of the mail can be maintained as far as the storage pocket.

Furthermore, it is advantageous if the transport path for the mail containers has at least two narrow finger belts running beside each other at a fixed to distance and, in order to put the mail containers into the transport path or to remove them from the latter, transport rollers which can be raised and lowered under control are arranged at the side of the transport path and between the finger belts. The largest directional component during the input or output in this case runs at right angles to the transport direction of the transport path. As a result, the actions of putting the mail containers in and out can be implemented with little effort.

In a further advantageous refinement, stationary actuators that can be driven in order to open the storage pockets are arranged along the transfer sections of the mail buffer stores. In each case a closing element is provided at the end of the transfer sections.

In order to determine the height of the stack of mail in the mail containers advantageously, a sensor arrangement for determining the stack height is arranged above the transport path of the containers, after the transfer sections and before the device for putting the mail containers in and out of the transport path.

As opposed to this, hitherto an appropriate sensor had to be arranged at each end point or a calculation of the stack height had to be carried out by means of the measured thicknesses of the individual items of mail.

BRIEF DESCRIPTION OF THE SEVERAL VIEWS OF THE DRAWINGS

In the following, the invention will be explained in more detail in an exemplary embodiment by using the drawing, in which.

DETAILED DESCRIPTION OF THE INVENTION

Figure 1:
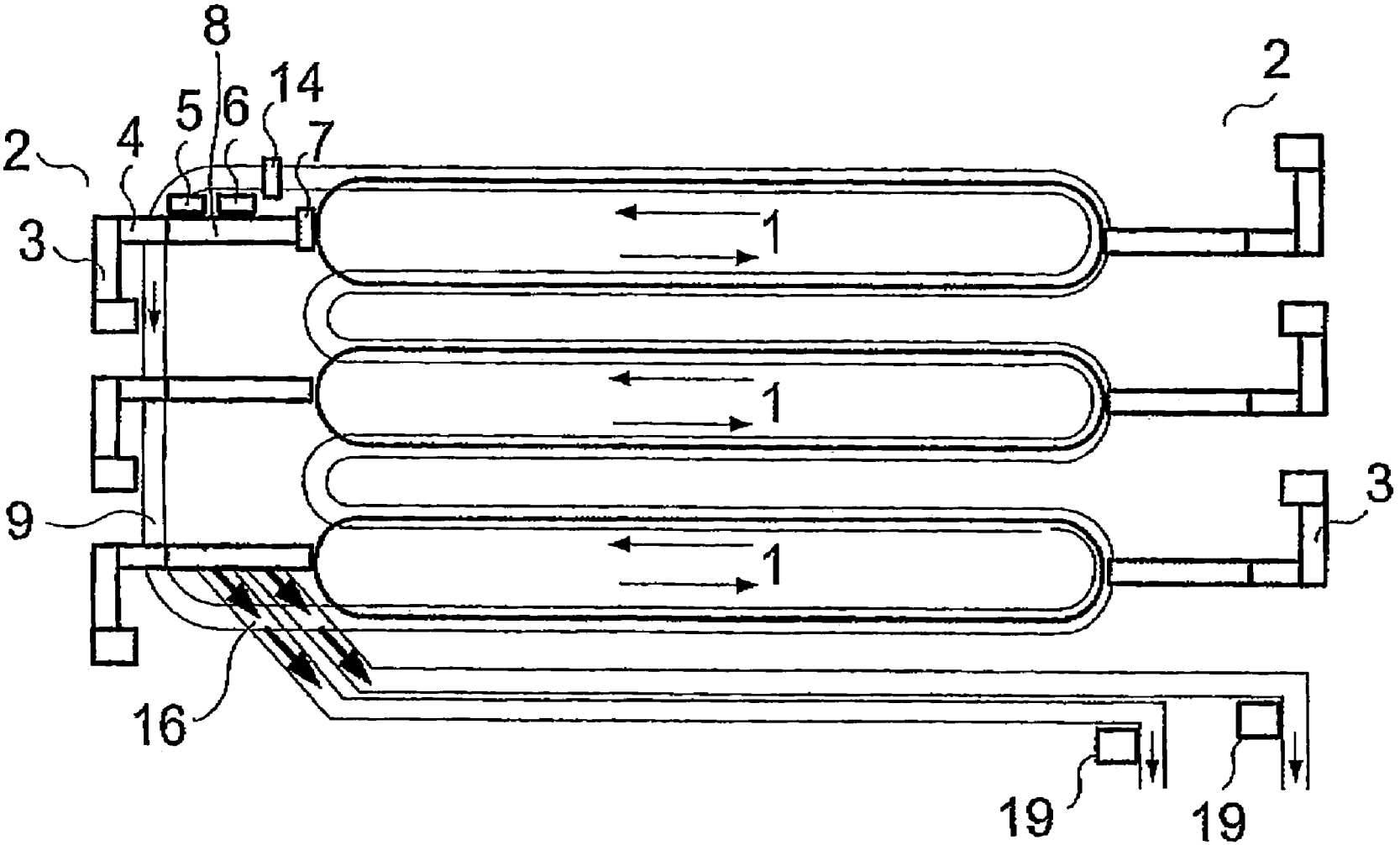
FIG. 1 shows a schematic plan view of a sorting device having 3 mail buffer stores.
Figure 2:
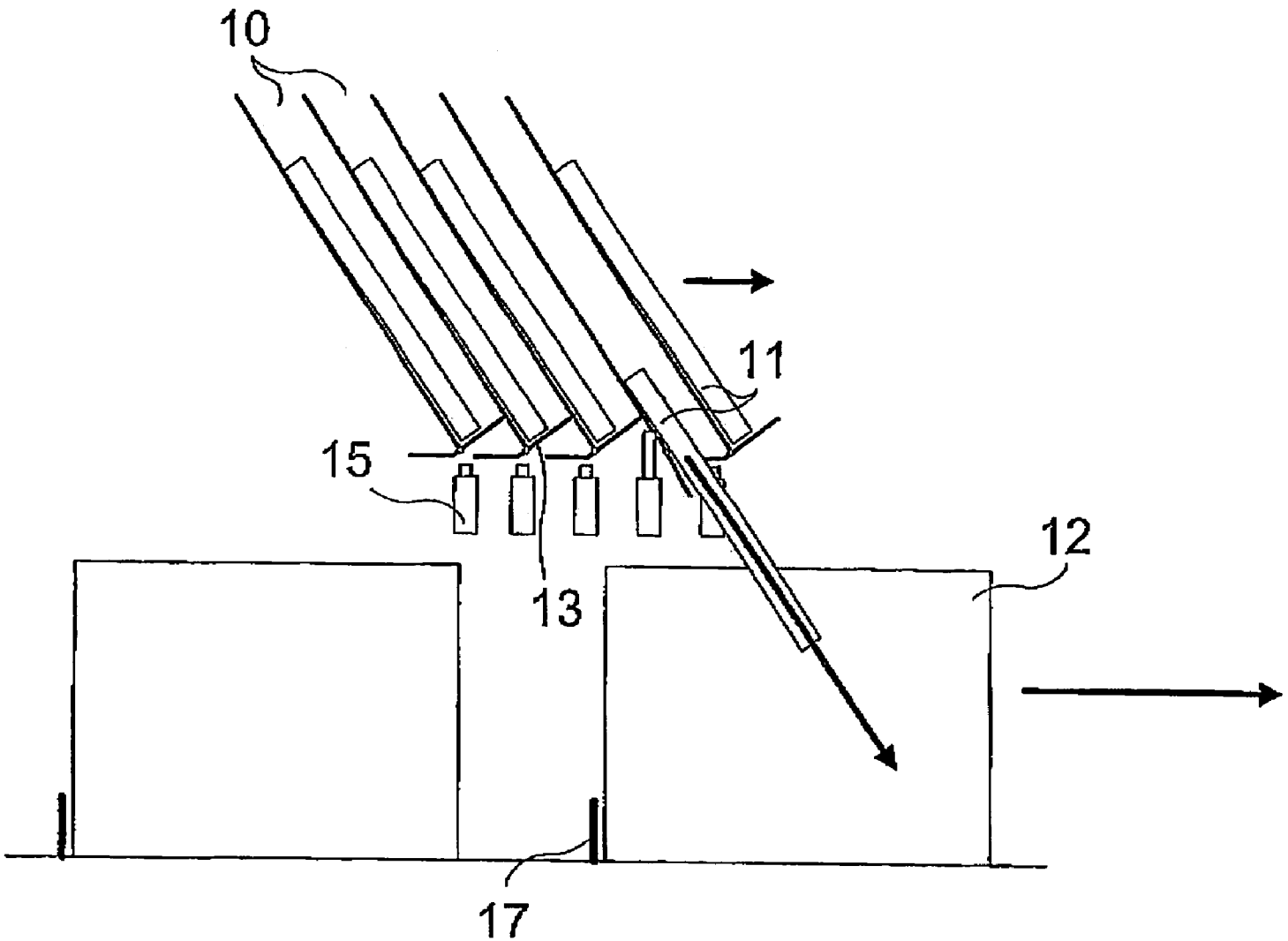
FIG. 2 shows a schematic side illustration of the storage pockets above the mail containers.
Figure 3:
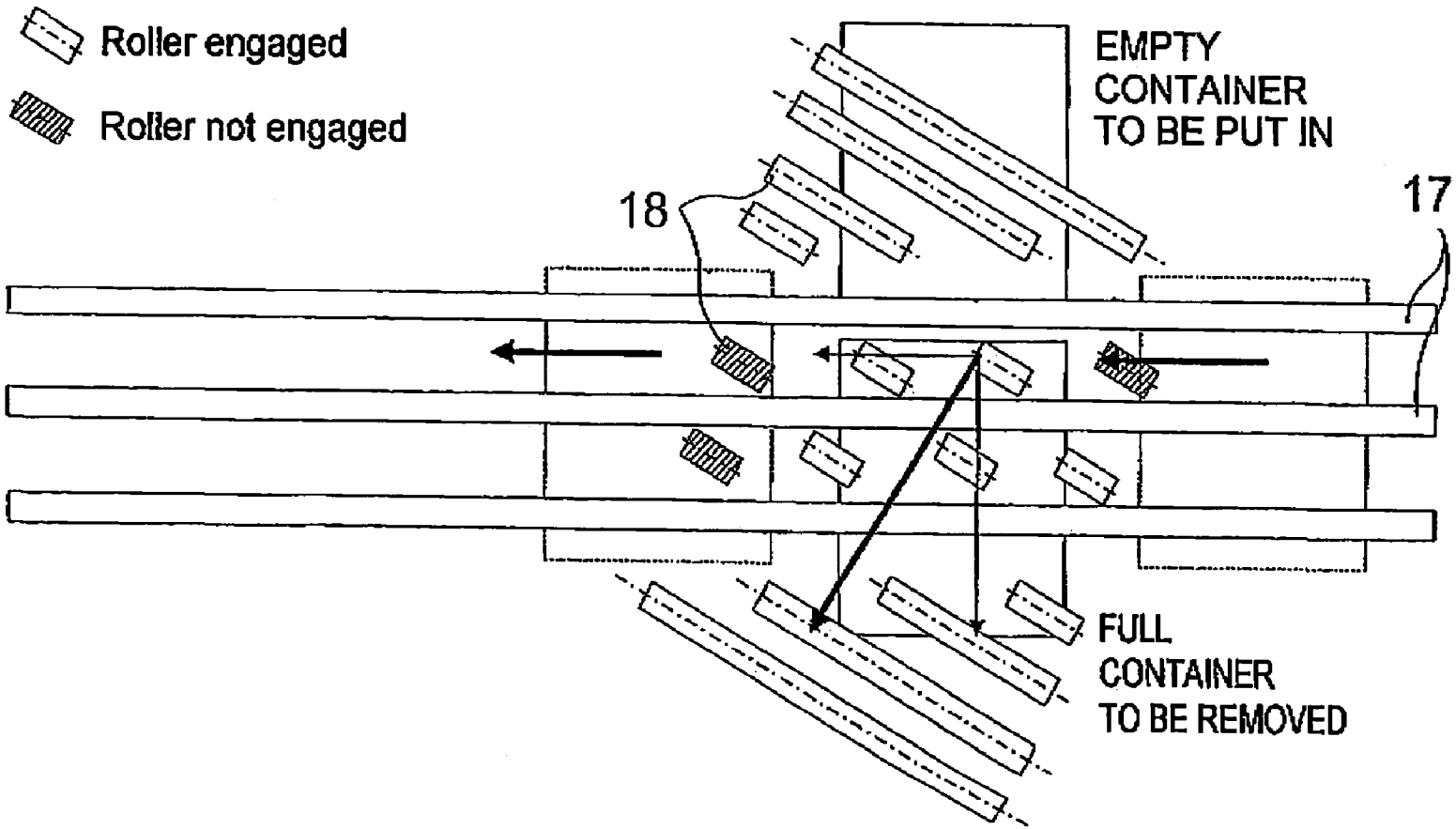
FIG. 3 shows a schematic illustration of an input and output device for mail containers (view from below).

As can be seen from FIG. 1, 3 mail buffer stores 1 are arranged beside one another. Each mail buffer store 1 comprises storage pockets which circulate continuously in a conveyor loop, are arranged one after another and can be unloaded downward under control by means of an opening mechanism, it order to accommodate the items of mail in an upright position. Each conveyor loop has two straight transfer sections and, between the latter, two semicircular sections. The storage pockets are open naturally to the outside and on each semicircular section of a conveyor loop there is a loading station 7, in which items of mail are transported individually through the lateral openings into the empty storage pockets. The loading station 7 receives the items of mail in each case individually one after another from an input unit 2, in which the items of mail from stacks of mail, separated by means of a mail separating device 3, are aligned in an alignment section 4 and are then transported with the aid of a transport device 8 past process appliances, such as an address reader 5 or a bar code printer 6 for applying an identification code, to the loading station 7. In each semicircular section of the conveyor loops of the mail buffer stores 1, items of mail are put into the storage pockets, that is to say the system has 6 input units 2 and loading stations 7. Underneath the circulating storage pockets, mail containers open at the top are likewise moved circulating continuously on a transport path 9 as final sorting points. This is done in such a way that the mail containers are transported directly under all the straight transfer sections of the mail buffer stores 1 in the same conveying direction as the storage pockets, that is to say the transport path rdns in the shape of a meander here. The transport speed of the mail containers is fixed such that each mail container is moved through underneath each storage pocket during its passage through a transfer section. The speed of the storage pockets is therefore relatively low (e.g. 0.1 m/s) as compared to the mail containers (e.g. 1 m/s), which has a beneficial effect on the reliable operation of the input units and the loading stations. Because of the parallelization of the input processes of a plurality of mail buffer stores 1 as illustrated, which is not possible to the same extent in the prior sit with stationary end points, the throughput of the sorting device can be increased. A further advantage is that no relatively long mail passage sections after the address reader are need it in order to provide the necessary time for determining the address. If it is assumed that the diameter of the semicircular sections of the conveyor loops of the mail buffer stores 1 is 2 m, then about 15 s are available after the storage pocket has been loaded until it enters the straight transfer section. The basic construction of the mail buffer stores 1 with the circulating storage pockets 10 and the unloading of the items of mail 11 lying horizontally into the mail containers 12 are illustrated in FIG. 2. The direction of movement of the storage pockets 10 and of the mail containers 12 is identified by the arrows. In order to measure the filling level of the mail containers 12 and, on this basis, to determine when the filled mail container 12 is to be the removed and replaced by an empty mail container 12, there is a sensor arrangement 14 for measuring the stack height for example as a laser sensor, above the transport path after the mail buffer stores 1 and before an input and output device 16. If the maximum stack height has not yet been reached, then the relevant mail container 12 passes through a further circuit. If it has been reached or exceeded, the output is carried out. The basic structure of the input and output device 16 is illustrated in FIG. 3.

The storage pockets 10 of the mail buffer store 1, inclined rearward in the direction of movement for the purpose of better unloading, circulate at a relatively low speed as compared with the mail containers 12. The number of storage pockets 10 needed is determined from the throughput of the mail separating device 3 and the time for a complete container circuit plus any possibly necessary process times for the determination of the sorting destination. This ensures that each item of mail 11 is kept in the mail buffer store 1 until the mail container 12 assigned in accordance with the destination address and sorting plan reaches the storage pocket 10.

The storage pockets 10 are constructed in such a way that they can be loaded with the separated items of mail 11 from the side, and that they can discharge the respective item of mail 11 downward, driven by the force of gravity, into the mail container 12 running past on three spaced-apart finger belts 17, following the actuation of a flap construction 13 as a pocket base. The flaps in this flap construction 13 are equipped with a lever of a certain longitudinal extent, such that time-controlled actuation, for example in accordance with a previously determined mail characteristic (e.g. thickness) can be carried out and the triggering time can be varied slightly with the effect of an optimal stacking quality. The location and number of stationary actuators 15 for opening the storage pockets 10 (e.g. lifting magnets) must be defined in such a way that timely triggering of each storage pocket 10 in combination with each mail container 12 running past is ensured.

The following further design variants are possible or advantageous:

the mail containers 12 can also be transported inclined, so that an inclined base with one or two preferential stacking edge/s is produced. Accordingly, the mail buffer stores 1 can also be inclined.

In the input and output devices 16 for mail containers 12 there are, between the individual finger belts 17 of the transport path 9 and at the side of the transport path 9, driven rollers 18 which are set at an angle, which can be raised and lowered above the fingers of the finger belts 17 under timed control by means of suitable actuators (for example pneumatically or electrically driven levers), so that they lift the mail container 12 located about the rollers 18 at that instant above the finger belts 17, while maintaining the transport speed component of the finger belt 17, move it transversely with respect to the finger belt 17 and therefore put it into the stream (empty container) or remove it from the stream (full container). In order to increase the process reliability, additional mechanical guide devices can also be used.

In order to have sufficient time available to remove adjacent mail containers 12 as well, and also to shorten the discharge time, two input and output devices 16 are provided. The filled mail containers 12 that are removed finally pass via a storage section to labelling modules 19, where they are provided with appropriately printed labels for the purpose of identification and coding (address range).

The invention claimed is:

1. A sorting device for flat items of mail, comprising:

at least one mail buffer store having a conveying loop and a plurality of storage pockets configured to circulate in the conveying loop, wherein the conveying loop transports the storage pockets at a first transport speed;

a loading station assigned to the at least one mail buffer store and configured to load individual items of mail into empty storage pockets;

at least one input station having a mail separating device and a transport device for transporting separated items of mail to the loading station of the mail buffer store;

a transport path configured to continuously circulate mail containers at a second transport speed;

at least one input device for empty mail containers and at least one output device for filled mail containers, both coupled to the transport path;

at least one stationary actuator arranged along a straight transfer section and configured to open the storage pockets; and a closing element arranged at an end of the transfer section, wherein the transport path and the conveyor loop are arranged so that the mail containers move underneath the transfer section of the conveyor loop to transfer the individual items of mail from a storage pocket of the conveyor loop to a mail container of the transport path in accordance with a read destination addresses, wherein the storage pockets are configured to open in a controlled manner at a time at which a storage pocket is located in an appropriate position above the associated mail container, and wherein the transport speeds and a length of the transfer section are selected so that, during a time interval in which a storage pocket passes through the transfer section, each mail container moves through underneath this storage pocket.

2. The sorting device according to claim 1, wherein the storage pockets are configured to accommodate the items of mail in an upright position, and wherein the storage pockets are inclined counter to a transport direction of the mail containers.

3. The sorting device according to claim 2, wherein the mail containers are inclined in the same direction as the storage pockets.

4. The sorting device according to claim 1, wherein the mail containers transported underneath the transfer section move in a same transport direction as the storage pockets.

5. The sorting device according to claim 1, further comprising a transport device coupled to the loading station, wherein the storage pockets comprise means for opening at a side and are arranged so as to be led with the open side past an end section of the transport device in order to load the storage pockets at the loading station.

6. The sorting device according to claim 1, wherein the transport pat for the mail containers comprises at least two narrow coupled finger belts running beside each other at a fixed distance and, in order to put the mail containers into the transport path or to remove them from the latter, transport rollers configured to be raised and lowered under control are arranged at a side of the transport path and between the finger belts, wherein a largest directional component during the input or output runs at a right angle to a transport direction of the transport path.

7. The sorting device according to claim 1, further comprising a sensor arrangement arranged to determine a stack height and further arranged above the transport path of the containers, after the transfer section and before the input device and the output device.

8. A sorting device for flat items of mail, comprising:

at least one mail buffer store having a conveying loop and a plurality of storage pockets configured to circulate in the conveying loop, wherein the conveying loop transports the storage pockets at a first transport speed;

a loading station assigned to the at least one mail buffer store and configured to load individual items of mail into empty storage pockets;

at least one input station having a mail separating device and a transport device for transporting separated items of mail to the loading station of the mail buffer store;

a transport path configured to continuously circulate mail containers at a second transport speed;

at least one input device for empty mail containers and at least one output device for filled mail containers, both coupled to the transport path; and a transport device coupled to the loading station, wherein the storage pockets comprise means for opening at a side and are arranged so as to be led with the open side past an end section of the transport device in order to load the storage pockets at the loading station, wherein the transport path and the conveyor loop are arranged so that the mail containers move underneath a straight transfer section of the conveyor loop to transfer the individual items of mail from a storage pocket of the conveyor loop to a mail container of the transport path in accordance with a read destination addresses, wherein the storage pockets are configured to open in a controlled manner at a time at which a storage pocket is located in an appropriate position above the associated mail container, and wherein the transport speeds and a length of the transfer section are selected so that, during a time interval in which a storage pocket passes through the transfer section, each mail container moves through underneath this storage pocket.

9. A sorting device for flat items of mail, comprising:

at least one mail buffer store having a conveying loop and a plurality of storage pockets configured to circulate in the conveying loop, wherein the conveying loop transports the storage pockets at a first transport speed;

a loading station assigned to the at least one mail buffer store and configured to load individual items of mail into empty storage pockets;

at least one input station having a mail separating device and a transport device for transporting separated items of mail to the loading station of the mail buffer store;

a transport path configured to continuously circulate mail containers at a second transport speed;

at least one input device for empty mail containers and at least one output device for filled mail containers, both coupled to the transport path;

a sensor arrangement positioned above the transport path after the transfer section and before the input device and the output device, and configured to determine a stack height, wherein the transport path and the conveyor loop are arranged so that the mail containers move underneath a straight transfer section of the conveyor loop to transfer the individual items of mail from a storage pocket of the conveyor loop to a mail container of the transport path in accordance with a read destination addresses, wherein the storage pockets are configured to open in a controlled manner at a time at which a storage pocket is located in an appropriate position above the associated mail container, and wherein the transport speeds and a length of the transfer section are selected so that, during a time interval in which a storage pocket passes through the transfer section, each mail container moves through underneath this storage pocket.

* * * * *